US009848747B2

(12) United States Patent
Seo

(10) Patent No.: US 9,848,747 B2
(45) Date of Patent: Dec. 26, 2017

(54) FLOOR CLEANING DEVICE

(71) Applicant: Changsuk Seo, Ansan-si (KR)

(72) Inventor: Changsuk Seo, Ansan-si (KR)

( * ) Notice: Subject to any disclaimer, the term of this patent is extended or adjusted under 35 U.S.C. 154(b) by 780 days.

(21) Appl. No.: 14/326,412

(22) Filed: Jul. 8, 2014

(65) Prior Publication Data

US 2015/0013103 A1 Jan. 15, 2015

Related U.S. Application Data

(60) Provisional application No. 61/844,413, filed on Jul. 9, 2013.

(51) Int. Cl.

| | |
|---|---|
| ***A47L 9/02*** | (2006.01) |
| ***A47L 9/04*** | (2006.01) |
| ***A47L 9/06*** | (2006.01) |
| *A47L 9/28* | (2006.01) |

(52) U.S. Cl.

CPC ..... *A47L 9/0483* (2013.01); *A47L 9/06* (2013.01); *A47L 9/0686* (2013.01); *A47L 9/0693* (2013.01); *A47L 9/2847* (2013.01); *A47L 9/2852* (2013.01)

(58) Field of Classification Search

CPC ..... A47L 9/06; A47L 9/0686; A47L 9/0693; A47L 9/2847; A47L 9/2852; A47L 9/0483

USPC ..... 15/382

IPC ..... A47L 5/00,9/02, 9/20

See application file for complete search history.

(56) References Cited

U.S. PATENT DOCUMENTS 2,233,252 A * 2/1941 Eckert ..... A47L 9/0405 15/382

* cited by examiner

*Primary Examiner* — David Redding

(74) *Attorney, Agent, or Firm* — Chanmin Park

(57) ABSTRACT

A floor cleaning device includes a floor covering compartment having a cleaning opening, a vacuum generating device, a suction pipe that connects the floor covering compartment to the vacuum generating device so that suction force is applied on the surface covered by the cleaning opening, a cleaning head body that holds the floor covering compartment, and a vibrating device that causes vibration of the floor covering compartment relative to the cleaning head body. The periphery of the cleaning opening is adapted to contact a surface to be cleaned so that a sealed cleaning space is formed inside the floor covering compartment and over the portion of the surface covered by the cleaning opening. Strong negative pressure is built up in the sealed cleaning space to enhance suction efficiency. Vibration temporarily breaks the sealed state to facilitate moving of the floor covering compartment.

19 Claims, 7 Drawing Sheets

FLOOR CLEANING DEVICE

CROSS-REFERENCE TO RELATED APPLICATION

This application claims priority on Provisional Application No. 61/844,413, filed on Jul. 9, 2013, the disclosure of which is incorporated by reference herein.

FIELD OF THE INVENTION

The present is related to vacuum cleaner heads. More specifically, the present invention is related to a device to enhance vacuum cleaning efficiency by installing a compartment within the body of the head, keeping sealed state between the head and the floor, and vibrating the inner compartment up and down.

BACKGROUND OF THE INVENTION

Vacuum cleaner heads by prior art have problems that they suffer waste of energy due to high output, and thus high performance air filter devices must be installed. Also, the length of the head cannot be effectively extended. Therefore, they are not considered efficient cleaners. Because vacuum cleaner heads by prior art have open bottom, they allow sucking unneeded air distributed at all directions. It wastes suction power thereby making efficient energy use difficult and lowering cleaning efficiency. There have long been needs for light, energy saving and extendible vacuum cleaner heads.

BRIEF SUMMARY OF THE INVENTION

An objective of the present invention is to provide a light weight and energy efficient vacuum cleaner head. Another objective of the present invention is to provide a simple, extendible structure for a vacuum cleaner head.

In order to achieve the objectives, the present invention provides a floor cleaning device comprising a floor covering compartment that comprises an cleaning opening, wherein the periphery of the cleaning opening is adapted to contact a surface to be cleaned whereby a sealed cleaning space is formed inside the floor covering compartment and over the portion of the surface covered by the cleaning opening, a vacuum generating device, a suction pipe that connects the floor covering compartment to the vacuum generating device whereby suction force is applied on the surface covered by the cleaning opening, a cleaning head body that holds the floor covering compartment; and a vibrating device that causes vibration of the floor covering compartment relative to the cleaning head body.

The cleaning head body comprises two or more rolling wheels, and the vibrating device comprises a link device that translates rolling movement of the rolling wheels into vertical movement, whereby the floor covering compartment vibrates with movement of the cleaning head body.

The vibrating device vibrates the cleaning head body, wherein the vibration of the cleaning body causes vibration of the floor covering compartment.

The distance of the cleaning opening from the axis of the rolling wheels is adjustable depending on the property of the surface to be cleaned.

The floor covering compartment further comprises a sealing band that is adapted to contact the surface to be cleaned and to seal the sealed cleaning space, wherein the sealing band is made of elastic material.

Preferably, the sealing band comprises a plurality of dense bristles.

The floor covering compartment further comprises a cloth strip attached to the periphery of the cleaning opening.

One or more air vent holes are provided on the floor covering compartment.

The size, number and position of the air vent holes are decided to keep the suction power of the floor cleaning device within a predetermined range.

Preferably, the air vent holes merge with the cleaning opening.

The frequency of the vibration is decided to keep the suction power of the floor cleaning device within a predetermined range.

In an embodiment, the cleaning head body comprises an outer compartment that is adapted to contact a surface to be cleaned, and surrounds the floor covering compartment.

One or more air vent holes are provided on the outer compartment.

The outer compartment comprises one or more side walls, and one or more floor covering compartment home plates that guide the floor covering compartment's up and down vibration movements.

The floor covering compartment home plates are spaced from the side wall of the outer compartment, and connected to the side wall of the outer compartment with rivets, wherein the floor covering compartment comprises one or more slots through which the rivets pass, wherein the home plates have a curved end facing toward the cleaning opening.

In an embodiment, the cleaning opening has triangular shape.

In another embodiment, the cleaning opening has oval shape.

In still another embodiment, the floor covering compartment comprises a left sub-compartment and a right sub-compartment. Each of the left sub-compartment and the right sub-compartment is retractable so that the area of the cleaning opening is adjustable.

The floor covering compartment comprises one or more vibrating sidewalls and one or more non-vibrating sidewalls. The bottoms of the vibrating sidewall(s) and the non-vibrating sidewall(s) form the periphery of the cleaning opening. The number and size of the vibrating sidewalls are decided to keep the suction power of the floor cleaning device within a predetermined range.

Various possibilities for the present invention are explained below.

A vibrator is installed inside or outside of a vacuum cleaner head, and is connected to the floor covering compartment, or inner compartment and vibrates the compartment.

The compartment need not be rectangular, but can be made aesthetically pleasing by design. The four sides of the inner compartment may be vibrated. Alternatively, a side(s) is fixed, and the front and rear sides, or left, right and front sides may be vibrated. The bottom portion of the compartment is made of latex having elasticity and durability, or synthetic material having such properties, or dense bristles that can keep sealed state; and can be vibrated up and down. The head itself may be connected to an axis of rolling wheels, and the head itself, not the compartment, can be vibrated up and down.

Air holes may be provided to the bottom of the compartment or the head. The size, number and position of the air holes can be decided based on output of a cleaner, property of the surface to be cleaned, and the length of the head.

Vibration frequency and vibration width can be decided based on the output of the cleaner.

Also, a device that can lift the head connected with the compartment above the axis of the rolling wheels, and be controlled remotely either manually or automatically, may be provided thereby facilitating cleaning rugs or bedding.

The present invention has following advantageous effects. The invention installs a sealed vibrating compartment to a vacuum cleaner head; seals the portion of the head that contacts the ground; with vibrating the compartment boosts the suction power; facilitates suction by hitting the ground with vibration thereby making fine dusts move, and effectively enables extending the length of the head resulting in improved efficiency of cleaning and saving in workers' labor, time and electrical energy. The invention prevents energy waste by concentrating suction power thereby enhancing efficiency; effectively removes dust trapped in rugs or bedding because it hits the bottom; and saves labor and time of user not only for home use but also industry use because the length of the head can be effectively extended.

BRIEF DESCRIPTION OF THE DRAWINGS

The invention will be more fully understood by reference to the detailed description in conjunction with the following figures, wherein.

DETAILED DESCRIPTION OF THE INVENTION

Figure 1:
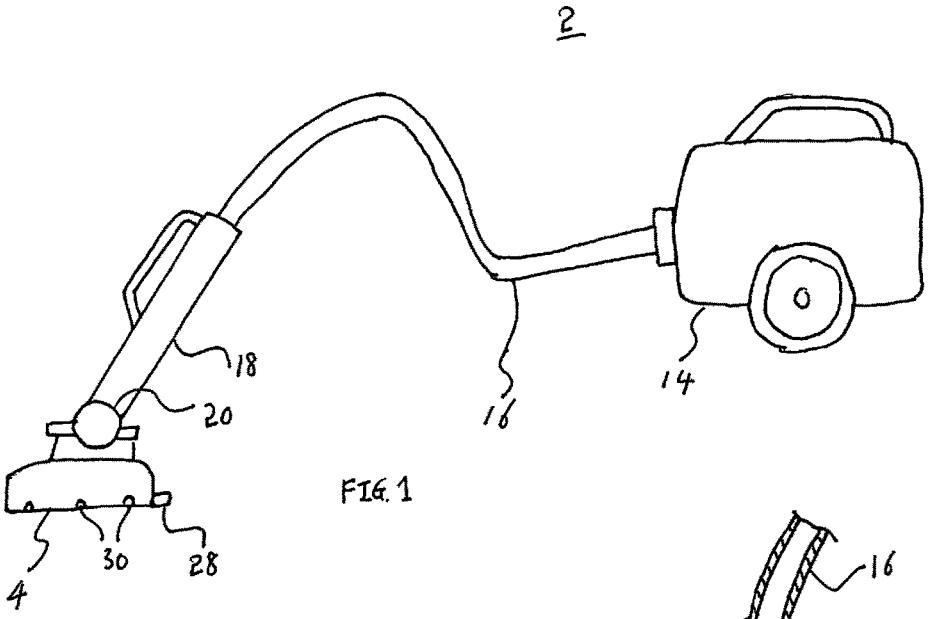
FIG. 1 is an elevation view of a floor cleaning device of canister type according to the present invention.
Figure 2:
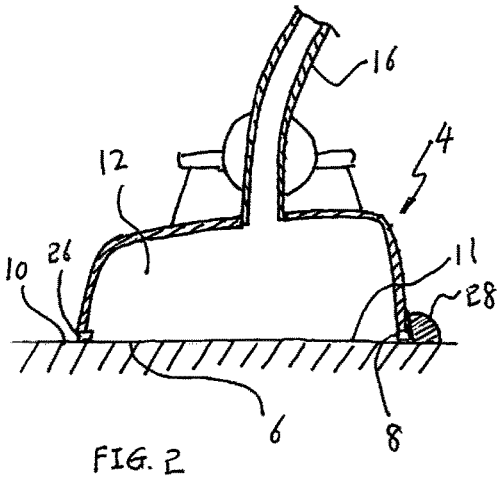
FIG. 2 is cross sectional view of a floor covering compartment.

Referring to FIGS. 1 and 2, a floor cleaning device 2 comprises a floor covering compartment 4 that comprises a cleaning opening 6, wherein the periphery 8 of the cleaning opening 6 is adapted to contact a surface 10 to be cleaned whereby a sealed cleaning space 12 is formed inside the floor covering compartment 4 and over the portion 11 of the surface 10 covered by the cleaning opening 6; a vacuum generating device 14; a suction pipe 16 that connects the floor covering compartment 4 to the vacuum generating device 14 whereby suction force is applied on the surface 10 covered by the cleaning opening 6; a cleaning head body 18 that holds the floor covering compartment 4; and a vibrating device 20 that causes vibration of the floor covering compartment 4 relative to the cleaning head body 18.

Figure 3:
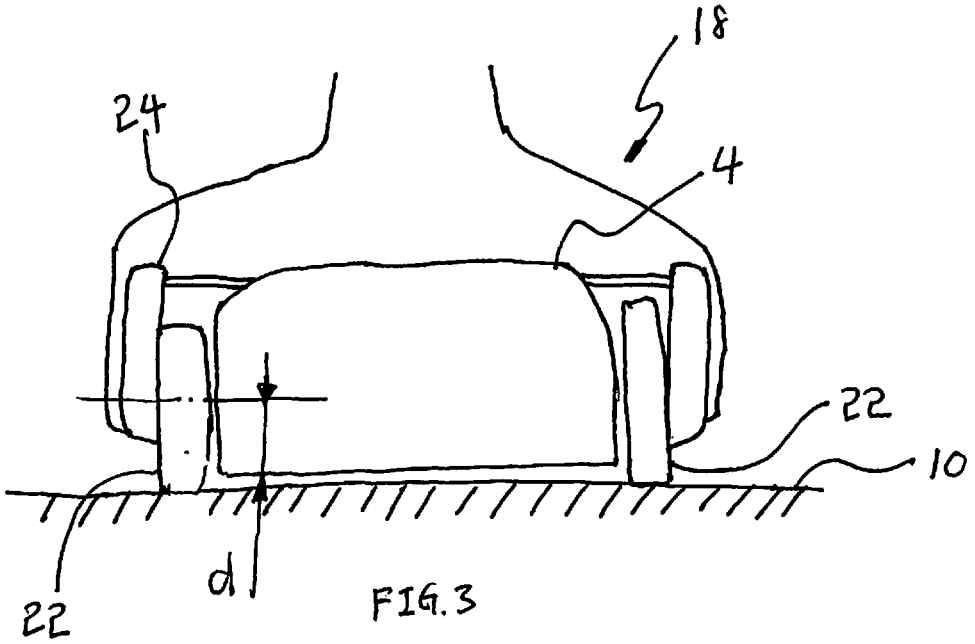
FIG. 3 is a schematic elevation view of a cleaner head with wheels.

Referring FIG. 3, the cleaning head body 18 comprises two rolling wheels 22, and the vibrating device 20 comprises a link device 24 that translates rolling movement of the rolling wheels 22 into vertical movement, for example with a crank mechanism, so that the floor covering compartment 4 vibrates with movement of the cleaning head body 18 along the surface 10 to be cleaned.

The distance d of the cleaning opening from the axis of the rolling wheels is adjustable depending on the property of the surface 10 to be cleaned.

Referring back to FIG. 1, the vibrating device 20 vibrates the cleaning head body 18. The vibration may be generated by a vibration motor (not shown) installed at the cleaning head body 18. The cleaning head body 18 and the floor covering compartment 4 have simple structure due to not having a rotating brush or other mechanisms therein, but have enhanced suction efficiency because of forming the sealed cleaning space 12. Therefore, for given capacity of a vacuum cleaner, the present invention realizes a lighter cleaning head. Due to the lightweight of the cleaning head body 18 and the floor covering compartment 4, the vibration of the cleaning head body 18 causes vibration of the floor covering compartment 4. Due to the lightweight of the cleaning head body 18 and the floor covering compartment 4, the energy required for the vibrating device 20 is also small. The light weight of moving parts and the vibration that temporarily releases the sealed state facilitates moving forward the floor covering compartment 4 along the surface 10 to be cleaned.

Figure 4:
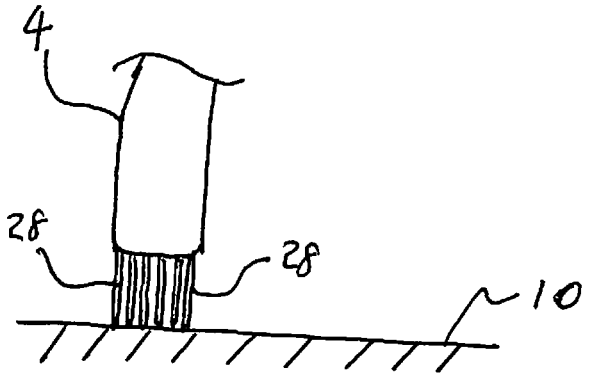
FIG. 4 is an enlarged elevation view of a sealing band.

Referring to FIG. 2, the floor covering compartment 4 further comprises a sealing band 26 that is adapted to contact the surface 10 to be cleaned and to seal the sealed cleaning space 12. The sealing band 26 is made of elastic material. Preferably, the sealing band 26 comprises a plurality of dense bristles 28 as shown in FIG. 4.

Referring to FIGS. 1 and 2, the floor covering compartment 4 further comprises a cloth strip 28 attached to the periphery of the cleaning opening 6. The cloth strip 28 is soaked with water and surfactant. The cloth strip 28 is attached to the trailing side of the floor covering compartment 4 and removes fine and viscous dusts that were not removed by the suction in the sealed cleaning space 12. One or more air vent holes 30 may be provided on the floor covering compartment 4. The size, number and position of the air vent holes 30 are decided to keep the suction power of the floor cleaning device 2 within a predetermined range in order to provide smooth and effortless operation of the floor cleaning device 2. In FIG. 1, the air vent holes 30 merge with the cleaning opening 6.

With similar reason, the frequency of the vibration of the vibrating device 20 is decided to keep the suction power of the floor cleaning device 2 within a predetermined range.

Figure 5:
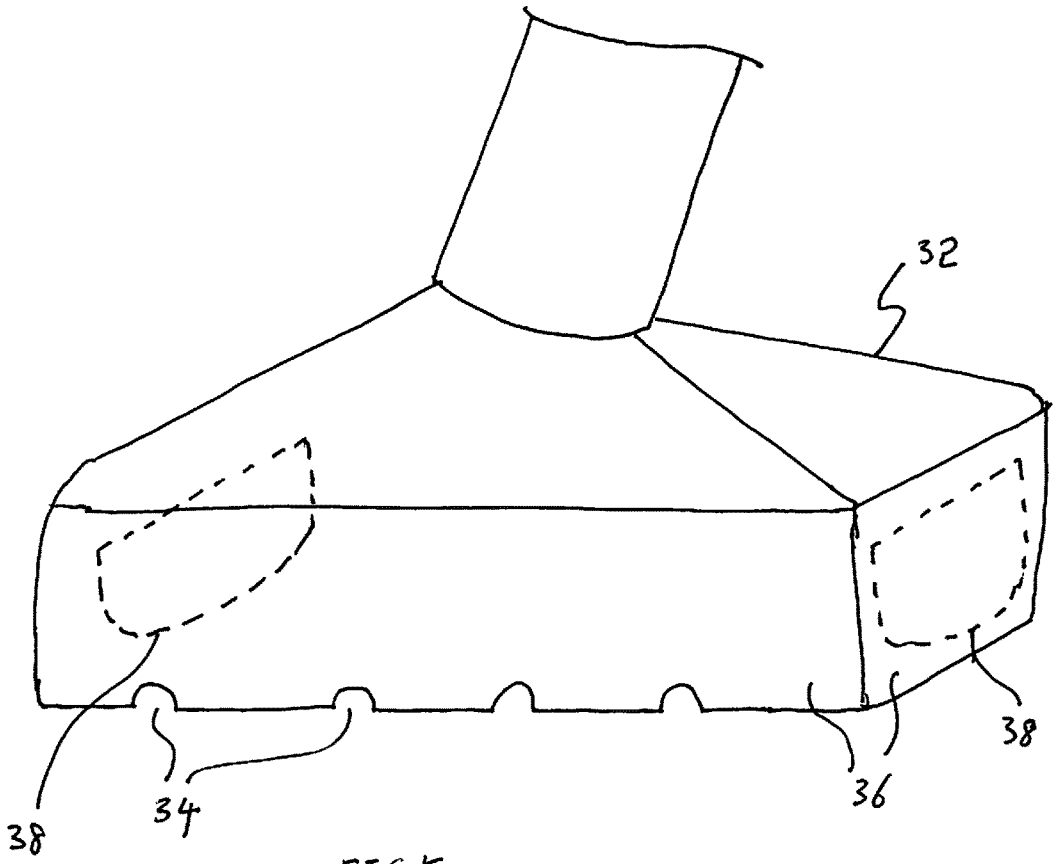
FIG. 5 is a perspective view of an outer compartment.
Figure 6:
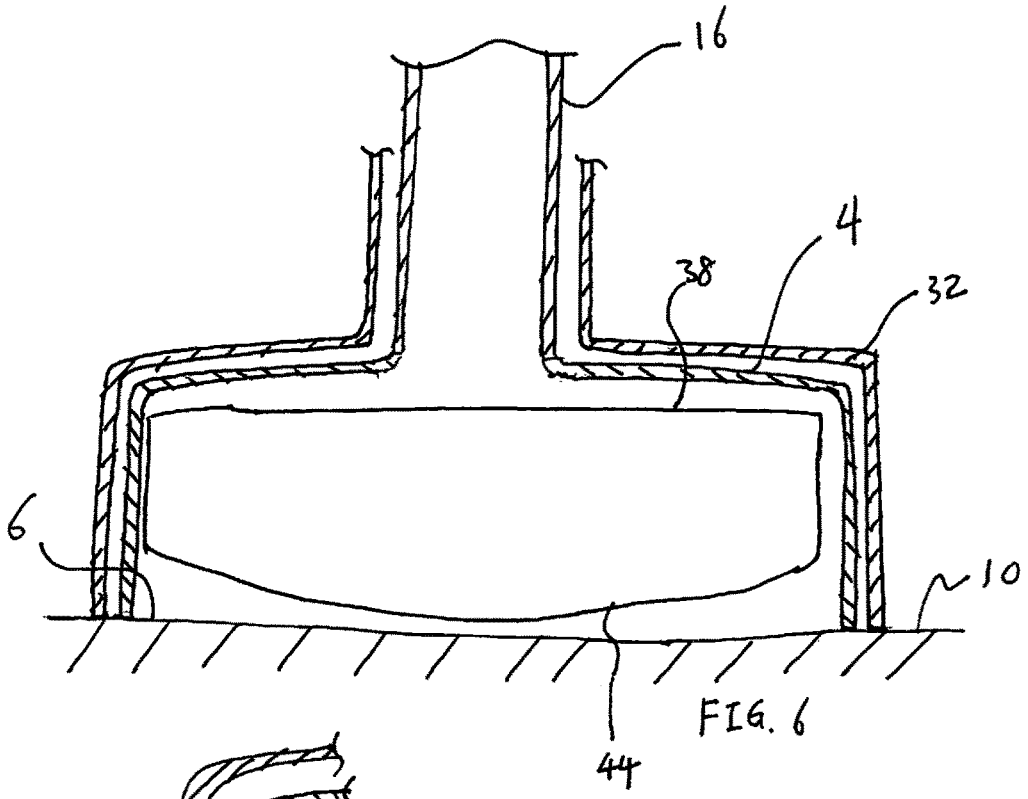
FIG. 6 is a cross-sectional view showing how the inner compartment moves in the outer compartment.
Figure 7:
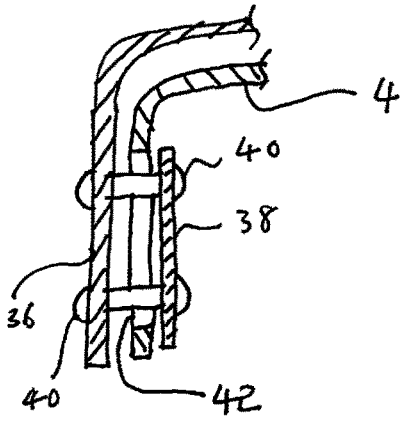
FIG. 7 is a cross-sectional view showing how home plates guide the movement of the inner compartment.

Referring FIGS. 5-7, the cleaning head body comprises an outer compartment 32 that is adapted to contact the surface 10 to be cleaned, and surrounds the floor covering compartment, or an inner compartment 4. One or more air vent holes 34 are provided on the outer compartment 32.

The outer compartment 32 comprises four side walls 36, and two floor covering compartment home plates 38 that guide the floor covering compartment's 4 up and down vibration movements.

The floor covering compartment home plates 38 are spaced from the side wall 36 of the outer compartment 32, and connected to the side wall 36 of the outer compartment 32 with rivets 40, wherein the floor covering compartment 4 comprises slots 42 through which the rivets 40 pass, wherein the home plates 38 have a curved end 44 facing toward the cleaning opening 6.

Figure 8:
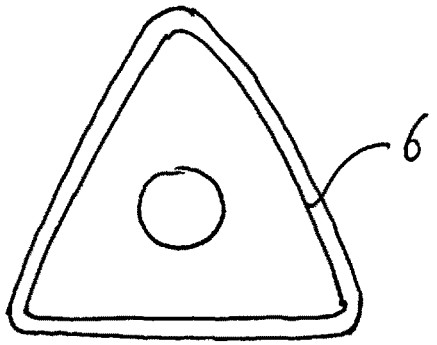
FIG. 8 is a plan view showing a triangular floor covering compartment.

In an embodiment shown in FIG. 8, the cleaning opening 6, and thus the floor covering compartment 4 has triangular shape.

Figure 9:
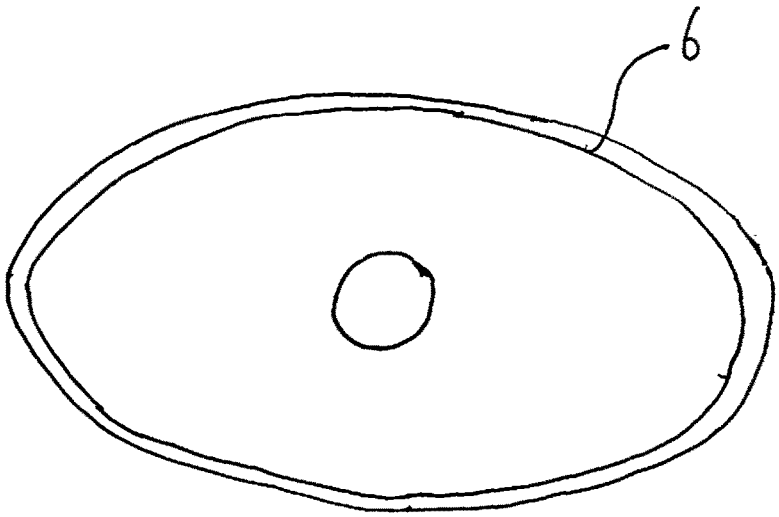
FIG. 9 is a plan view showing an oval floor covering compartment.

In another embodiment shown in FIG. 9, the cleaning opening 6 has oval shape.

Figure 10:
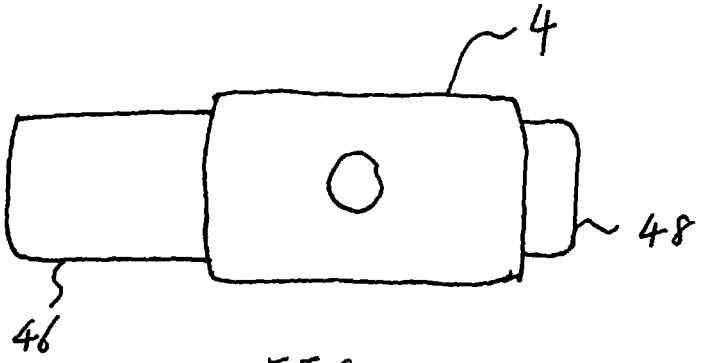
FIG. 10 is a plan view showing a floor covering compartment having retractable sub-compartments.

In still another embodiment shown in FIG. 10, the floor covering compartment 4 comprises a left sub-compartment 46 and a right sub-compartment 48. Each of the left sub-compartment 46 and the right sub-compartment 48 is retractable so that the area of the cleaning opening 6 is adjustable.

Figure 13:
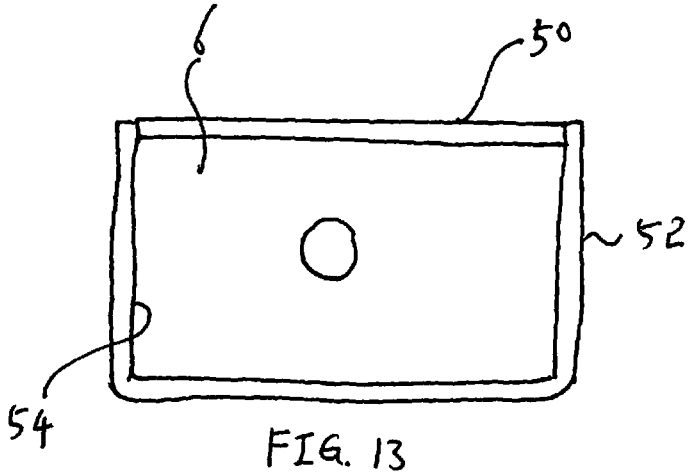
FIG. 13 is a plan view showing a floor covering compartment having a fixed wall and a vibrating wall.

Referring to FIG. 13, the floor covering compartment 4 comprises one or more vibrating sidewalls 50 and one or more non-vibrating sidewalls 52. The bottoms 54 of the vibrating sidewall(s) 50 and the non-vibrating sidewall(s) 52 form the periphery of the cleaning opening 6. The number and size of the vibrating sidewalls 50 are decided to keep the suction power of the floor cleaning device 2 within a predetermined range.

The present invention is further explained for possible variations.

FIG. 5 schematically illustrates an outer compartment that surrounds a vacuum cleaner head or inner compartment. The outer compartment primarily seals the vacuum cleaner head having four open sides. Between the outer compartment and inner compartment are home plates. Side walls of the inner compartment are inserted so that the inner compartment would not drop out when it is vibrated up and down. Also, the outer compartment and the inner compartment home plates are connected with rivets with each other. At the inner compartment, suitably long slots are provided through which the rivets pass so that the rivets will not hinder the movement of the inner compartment.

As shown in FIG. 6, the home plates are made shorter than the surface of the outer compartment, but tall enough so that the inner compartment will not drop out. And the end facing the floor is made as half-circle shape so that it will not block the air holes, and it can suck air, which flows into the compartment, more strongly by having such shape. It is possible to install these inner compartment home plates on all four surfaces of the compartment.

The inner compartment basically has the shape of the outer compartment. Above the two compartments, a space may be provided having sufficient size to enclose a vibrator. Alternatively, a vibrating device can be installed outside the vacuum cleaner head.

Air holes on the bottom of the compartment can be provided at the front and rear walls, or sidewall as illustrated in FIGS. 1 and 5. They can be provided at three sides other than the rear side so that the compartment is prevented from sticking to the floor and objects to be cleaned can be sucked through the air holes.

Vibration facilitates movement of the head. Due to the compartment that forms a sealed space with the floor to be cleaned, when there is no vibration, the head is pushed on to the floor to be cleaned with atmospheric pressure because of the suction power of the cleaner that makes the sealed space under negative pressure when it moves to adjacent surface to be cleaned after finishing cleaning of the surface covered by the projected surface of the compartment. Vibration facilitates the movement to adjacent surface to be cleaned because it instantaneously releases the sealed state in which the compartment contacts the floor. While the air holes are provided for various purposes as described above, it is possible to perform movement of the head to clean a prescribed surface without the air holes but with only vibration. Vibration facilitates movement of the head, and strengthens the sealed state inside the compartment even tighter thereby enables cleaning with less energy.

Apart from the dual structure of the inner and outer compartments, it is possible to make a structure with single compartment (refer to FIGS. 1 and 2). In this case, the same goal can be achieved by vibrating the single compartment of the head with respect to a bracket attached to a hose connected to the cleaner, rather than the relative movement of the inner compartment to the outer compartment (refer to FIGS. 3 and 7).

As shown in FIG. 3, rolling wheels are attached to one or more sides of the head, and where there is need for keep some distance between the head and the surface to be cleaned, like a carpet consisting of long fibers or bedding, depending on the surface to be cleaned, a suitable distance can be adjusted and kept between the surface to be cleaned and the compartment while applying said sealing and vibrating structure without change.

Figure 14:
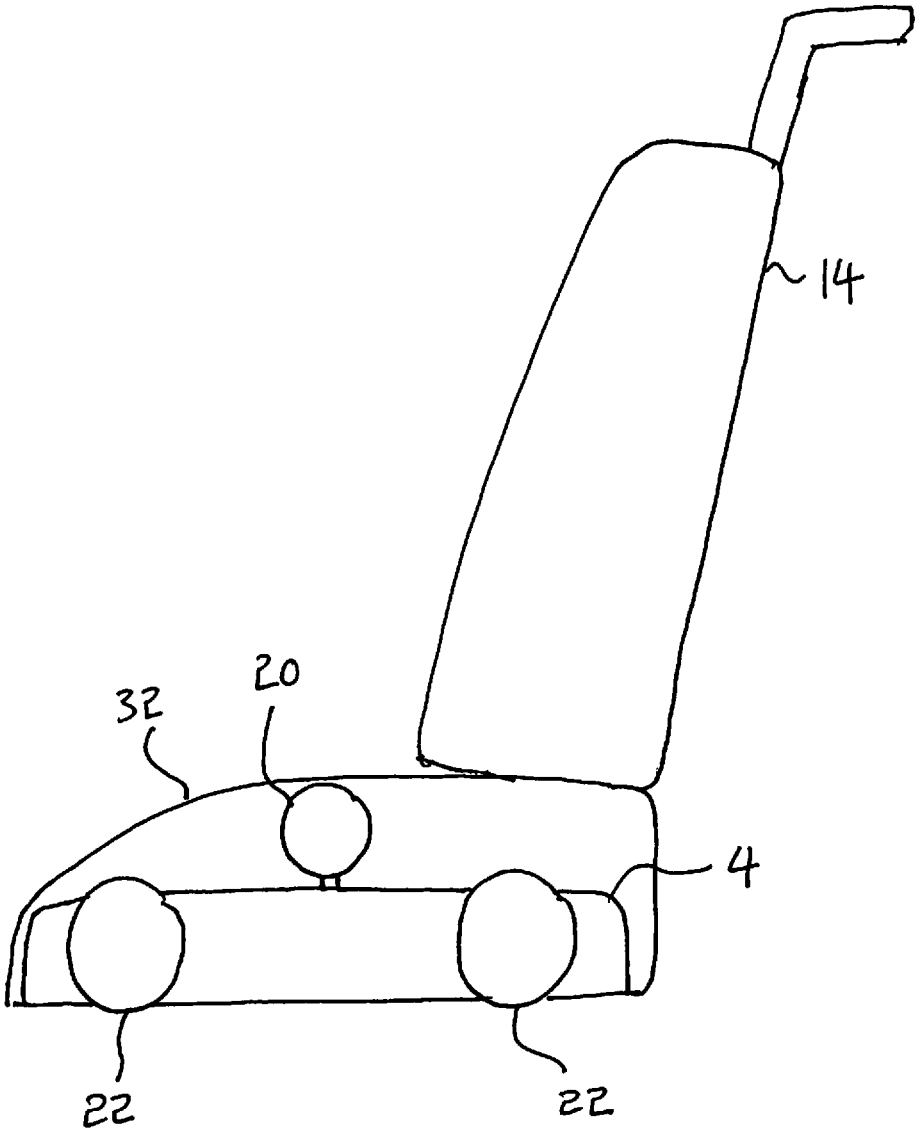
FIG. 14 is an elevation view showing a vacuum cleaner head of the present invention applied to a upright vacuum cleaner.

FIG. 14 shows an embodiment in which the suction head of the present invention is applied to an upright vacuum cleaner. For a guide connecting the inner compartment and the outer compartment, any structure that supports stable and smooth vibrating movement of the inner compartment may be used.

FIG. 1 shows an embodiment in which the suction head of the present invention is applied to a vacuum cleaner having a separated cleaning head. The head of this embodiment is a single compartment type.

FIGS. 8-12 are plan views showing heads of various shapes according to the present invention. With its unique sealing and vibration mechanism, the head of the present invention can realize a light and simple structured head without complex mechanism like conventional rotating brushes.

Figure 11:
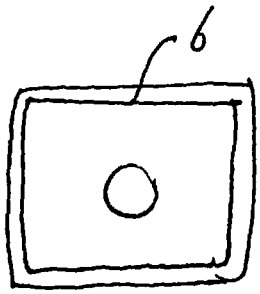
FIGS. 11 and 12 are plan views showing variations of rectangular floor covering compartment.
Figure 12:
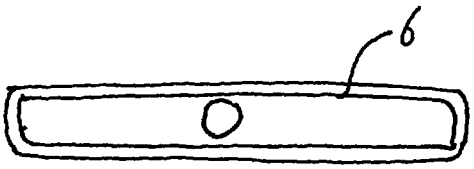

FIG. 11 and FIG. 12 show two heads having similar suction area, one having shape of narrow width and big size in the moving direction of the cleaner (FIG. 11), and the other having wide width and small size in the moving direction of the cleaner (FIG. 12).

FIG. 8 shows a triangular head, which is especially useful for a robot cleaner that performs long time cleaning with a small head. It is advantageous in that it can clean corners with its sharp edges, and it can clean while moving around an obstacle by changing directions and moving forward and backward when it hits the obstacle.

FIG. 9 shows an oval shaped head having big suction area. When first cleaning is done quickly for a large room, and detail space like gap between furniture is cleaned second, this head is suitable for the first cleaning that needs fast movement without damaging obstacles including furniture, etc.

FIG. 10 shows a head having left and right retractable head extensions. The left extension is illustrated in its extended state, and the right extension is illustrated in its retracted state to inside. Because this invention enables simple and light suction head mechanism, the retractable structure as FIG. 10 can easily be realized. The retractable structure of the extension is suitable for adjusting suction power according to change of suction area, or simultaneous cleaning of wall surface that meets the floor. For example, the right side has small suction area and big suction power, which is advantageous in cleaning a wall surface that meets the floor.

The above description is illustrative and is not restrictive, and, as it will become apparent to those skilled in the art upon review of the disclosure, the present invention may be embodied in other specific forms without departing from the essential characteristics thereof. The scope of the invention should, therefore, be determined not with reference to the above description, but instead should be determined with reference to the following and pending claims along with their full scope of equivalents.

The invention claimed is:

1. A floor cleaning device comprising:

a) a floor covering compartment that comprises a cleaning opening, wherein the periphery of the cleaning opening is adapted to contact a surface to be cleaned whereby a sealed cleaning space is formed inside the floor covering compartment and over the portion of the surface covered by the cleaning opening;

b) a vacuum generating device;

c) a suction pipe that connects the floor covering compartment to the vacuum generating device whereby suction force is applied on the surface covered by the cleaning opening;

d) a cleaning head body that holds the floor covering compartment; and e) a vibrating device that causes vibration of the floor covering compartment, wherein the frequency of the vibration of the vibration device is decided to keep the suction power of the floor cleaning device within a predetermined range.

2. The floor cleaning device of claim 1, wherein the cleaning head body comprises two or more rolling wheels, and the vibrating device comprises a link device that translates rolling movement of the rolling wheels into vertical movement, whereby the floor covering compartment vibrates with movement of the cleaning head body.

3. The floor cleaning device of claim 2, wherein the distance of the cleaning opening from the axis of the rolling wheels is adjustable depending on the property of the surface to be cleaned.

4. The floor cleaning device of claim 1, wherein the floor covering compartment further comprising a sealing band that is adapted to contact the surface to be cleaned and to seal the sealed cleaning space, wherein the sealing band is made of elastic material.

5. The floor cleaning device of claim 4, wherein the sealing band comprises a plurality of dense bristles.

6. The floor cleaning device of claim 1, wherein the floor covering compartment further comprises a cloth strip attached to the periphery of the cleaning opening.

7. The floor cleaning device of claim 1, wherein the cleaning head body comprises an outer compartment that is adapted to contact a surface to be cleaned, and surrounds the floor covering compartment.

8. The floor cleaning device of claim 7, wherein one or more air vent holes are provided on the outer compartment.

9. The floor cleaning device of claim 7, wherein the outer compartment comprises one or more side walls, and one or more floor covering compartment home plates that guide the floor covering compartment's up and down vibration movements.

10. The floor cleaning device of claim 9, wherein the floor covering compartment home plates are spaced from the side wall of the outer compartment, and connected to the side wall of the outer compartment with rivets, wherein the floor covering compartment comprises one or more slots through which the rivets pass, wherein the homeplates have a curved end facing toward the cleaning opening.

11. The floor cleaning device of claim 1, wherein the cleaning opening has triangular shape.

12. The floor cleaning device of claim 1, wherein the cleaning opening has oval shape.

13. The floor cleaning device of claim 1, wherein the floor covering compartment comprises a left sub-compartment and a right sub-compartment, wherein each of the left sub-compartment and the right sub-compartment is retractable, whereby the area of the cleaning opening is adjustable.

14. The floor cleaning device of claim 1, wherein the floor covering compartment comprises one or more vibrating sidewalls and one or more non-vibrating sidewalls, wherein the bottoms of the vibrating sidewall(s) and the non-vibrating sidewall(s) form the periphery of the cleaning opening.

15. The floor cleaning device of claim 14, wherein the number and size of the vibrating sidewalls are decided to keep the suction power of the floor cleaning device within a predetermined range.

16. A floor cleaning device comprising:

a) a floor covering compartment that comprises a cleaning opening, wherein the periphery of the cleaning opening is adapted to contact a surface to be cleaned whereby a sealed cleaning space is formed inside the floor covering compartment and over the portion of the surface covered by the cleaning opening;

b) a vacuum generating device;

c) a suction pipe that connects the floor covering compartment to the vacuum generating device whereby suction force is applied on the surface covered by the cleaning opening;

d) a cleaning head body that holds the floor covering compartment; and e) a vibrating device that causes vibration of the cleaning head body, wherein the frequency of the vibration of the vibration device is decided to keep the suction power of the floor cleaning device within a predetermined range.

17. The floor cleaning device of claim 16, wherein the cleaning head body comprises two or more rolling wheels, and the vibrating device comprises a link device that translates rolling movement of the rolling wheels into vertical movement, whereby the floor covering compartment vibrates with movement of the cleaning head body.

18. The floor cleaning device of claim 16, wherein the cleaning head body comprises an outer compartment that is adapted to contact a surface to be cleaned, and surrounds the floor covering compartment.

19. The floor cleaning device of claim 16, wherein the outer compartment comprises one or more side walls, and one or more floor covering compartment home plates that guide the floor covering compartment's up and down vibration movements.

* * * * *